US006506020B2

(12) United States Patent
Dailey

(10) Patent No.: US 6,506,020 B2
(45) Date of Patent: Jan. 14, 2003

(54) BLADE PLATFORM COOLING

(75) Inventor: Geoffrey M Dailey, Derby (GB)

(73) Assignee: Rolls-Royce plc, London (GB)

( * ) Notice: Subject to any disclaimer, the term of this patent is extended or adjusted under 35 U.S.C. 154(b) by 0 days.

(21) Appl. No.: 09/901,075

(22) Filed: Jul. 10, 2001

(65) Prior Publication Data

US 2002/0012589 A1 Jan. 31, 2002

(30) Foreign Application Priority Data

Jul. 29, 2000 (GB) ..... 0018541

(51) Int. Cl.[7] ..... F01D 5/18
(52) U.S. Cl. ..... 416/96 R; 416/97 R
(58) Field of Search ..... 416/1, 97 R, 193 A, 416/239, 96 R; 415/115

(56) References Cited

U.S. PATENT DOCUMENTS

| | | | | |
|---|---|---|---|---|
| 3,066,910 A | * | 12/1962 | Bluck | |
| 3,446,481 A | * | 5/1969 | Kydd | |
| 4,505,640 A | | 3/1985 | Hsing | |
| 4,672,727 A | * | 6/1987 | Field | 29/156.8 |
| 5,340,278 A | * | 8/1994 | Magowan | 416/96 R |
| 5,382,135 A | * | 1/1995 | Green | 416/97 R |
| 6,017,189 A | * | 1/2000 | Judet et al. | 416/97 R |
| 6,341,939 B1 | * | 1/2002 | Lee | 416/97 R |
| 6,402,471 B1 | * | 6/2002 | Demers et al. | 416/96 R |

FOREIGN PATENT DOCUMENTS

| | | |
|---|---|---|
| EP | 0 232 782 A | 8/1987 |
| GB | 742 476 SP | 12/1955 |
| GB | 798 689 SP | 7/1958 |
| GB | 806 033 SP | 12/1958 |
| GB | 884 409 SP | 12/1961 |
| GB | 895 077 SP | 5/1962 |
| GB | 2 095 765 A | 10/1982 |
| GB | 2 319 308 A | 5/1998 |

* cited by examiner

*Primary Examiner*—Edward K. Look
*Assistant Examiner*—James M McAleenan
(74) *Attorney, Agent, or Firm*—W. Warren Taltavull; Manelli Denison & Selter PLLC

(57) ABSTRACT

A turbine assembly for a gas turbine engine includes a plurality of turbine blades (32) mounted on a rotatable support means in the form of a turbine disc so as to extend radially therefrom. The turbine blades include circumferentially extending blade platforms (40) spaced from the turbine disc and means are provided for allowing the passage of air between an internal region of the blades (32) and a space located between the blade platforms (40) and the turbine disc. The air may flow out of and back into the same turbine blade, or may flow into an adjacent blade. This flow of air results in the cooling of the blade platforms (40).

9 Claims, 4 Drawing Sheets

BLADE PLATFORM COOLING

FIELD OF THE INVENTION

The invention relates to the cooling of gas turbine engine turbine blades, and particularly to the cooling of blade platforms.

BACKGROUND OF THE INVENTION

A turbine assembly for a gas turbine engine generally includes a plurality of turbine blades mounted on a turbine disc so as to protrude radially therefrom. Each blade includes an aerofoil, which projects into the path of hot gases flowing axially through the turbine, and a circumferentially extending blade platform located at the radially inner base of the aerofoil. The turbine blades are closely spaced around the circumference of the rotor disc and the blade platforms meet to form a smooth annular surface.

Turbine blades are required to operate at high temperatures and turbine blade cooling is thus very important. It is known to cause air to flow through passages within the aerofoils of turbine blades, before expelling the air through orifices in the aerofoil surface. The internal air flow cools the blade by convection and the expelled air also forms a cooling film over the surface of the blade. This cools the aerofoil but does not result in significant cooling of the blade platforms.

SUMMARY OF THE INVENTION

According to the invention there is provided a turbine assembly including a plurality of turbine blades mounted on a rotatable support means so as to extend radially therefrom, wherein at least one turbine blade includes a blade platform spaced from the support means and wherein means are provided for allowing the passage of air from an internal region of the blade to a space located between the blade platform and the support means.

Preferably means are also provided for allowing the passage of air from the space into the blade.

The internal region of the blade may include one or more internal passageways for receiving cooling air, and means may be provided for allowing the passage of air from a first passageway to the space and for allowing the passage of air from the space to a second passageway. Preferably the blade includes an aerofoil portion located radially outwardly of the blade platform and the internal passageways extend into the aerofoil portion.

The assembly may further include means for allowing the passage of air from the space into an internal region of an adjacent blade.

Preferably the means for allowing the passage of air includes a plurality of orifices provided in a surface of the turbine blade.

The blade may include a root portion for mounting the blade on the rotatable support means and a shank portion extending between the root portion and the blade platform, and the orifices may be provided in the shank portion.

The turbine assembly may include a means for providing cooling air to the turbine blade via a passageway extending through its root portion.

An undersurface of the blade platform may be provided with a plurality of projections.

According to the invention there is further provided a gas turbine engine including a turbine assembly as defined in any of the preceding eight paragraphs.

According to the invention there is also provided a method of cooling a turbine assembly according to any of the above definitions, the method including the steps of passing air from an internal region of a turbine blade to the space, and passing air from the space into the internal region of the turbine blade or into an internal region of an adjacent turbine blade.

According to the invention there is further provided a turbine blade adapted for use in a turbine assembly according to any of the previous definitions.

According to the invention there is further provided a turbine blade for mounting on a rotatable support means so as to extend radially therefrom, the blade including a blade platform spaced from the support means in use and means for allowing air to pass from an internal region of the blade to a space located in use between the blade platform and the support means.

According to the invention there is further provided a turbine blade for mounting on a rotatable support means so as to extend radially therefrom, the turbine blade including a root portion for mounting the blade on the support means, a blade platform spaced from the root portion and a shank portion extending between the root portion and the blade platform, and wherein a surface of the shank portion is provided with a plurality of orifices for allowing the passage of air to and from an internal region of the blade.

BRIEF DESCRIPTION OF THE DRAWINGS

An embodiment of the invention will be described for the purpose of illustration only with reference to the accompanying drawings in which.

DETAILED DESCRIPTION OF THE INVENTION

Figure 1:
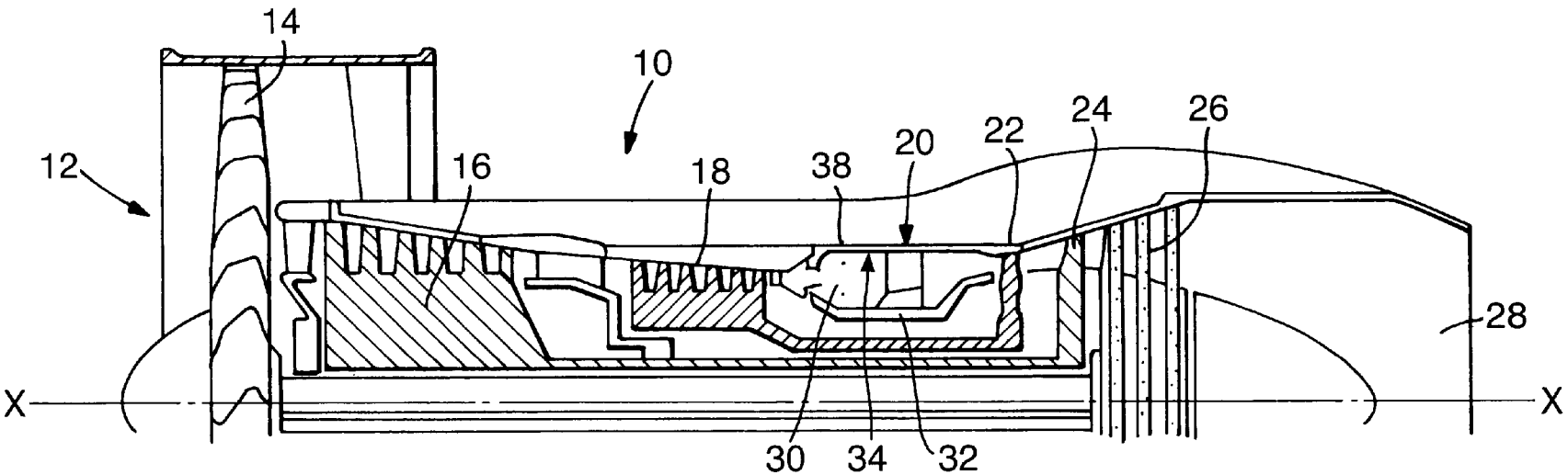
FIG. 1 is a schematic diagram of a ducted fan gas turbine engine.

With reference to FIG. 1 a ducted fan gas turbine engine generally indicated at 10 comprises, in axial flow series, an air intake 12, a propulsive fan 14, an intermediate pressure compressor 16, a high pressure compressor 18, combustion equipment 20, a high pressure turbine 22, an intermediate pressure turbine 24, a low pressure turbine 26 and an exhaust nozzle 28.

The gas turbine engine 10 works in the conventional manner so that air entering the intake 12 is accelerated by the fan 14 to produce two air flows, a first air flow into the intermediate pressure compressor 16 and a second airflow which provides propulsive thrust. The intermediate pressure compressor 16 compresses the air flow directed into it before delivering the air to the high pressure compressor 18 where further compression takes place.

The compressed air exhausted from the high pressure compressor 18 is directed into the combustion equipment 20 where it is mixed with fuel and the mixture combusted. The resultant hot combustion products then expand through and thereby drive the high, intermediate and low pressure turbines 22, 24 and 26 before being exhausted through the nozzle 28 to provide additional propulsive thrust. The high, intermediate and low pressure turbines 22, 24 and 26 respectively drive the high and intermediate pressure compressors 16 and 18 and the fan 14 by suitable interconnecting shafts.

Figure 2:
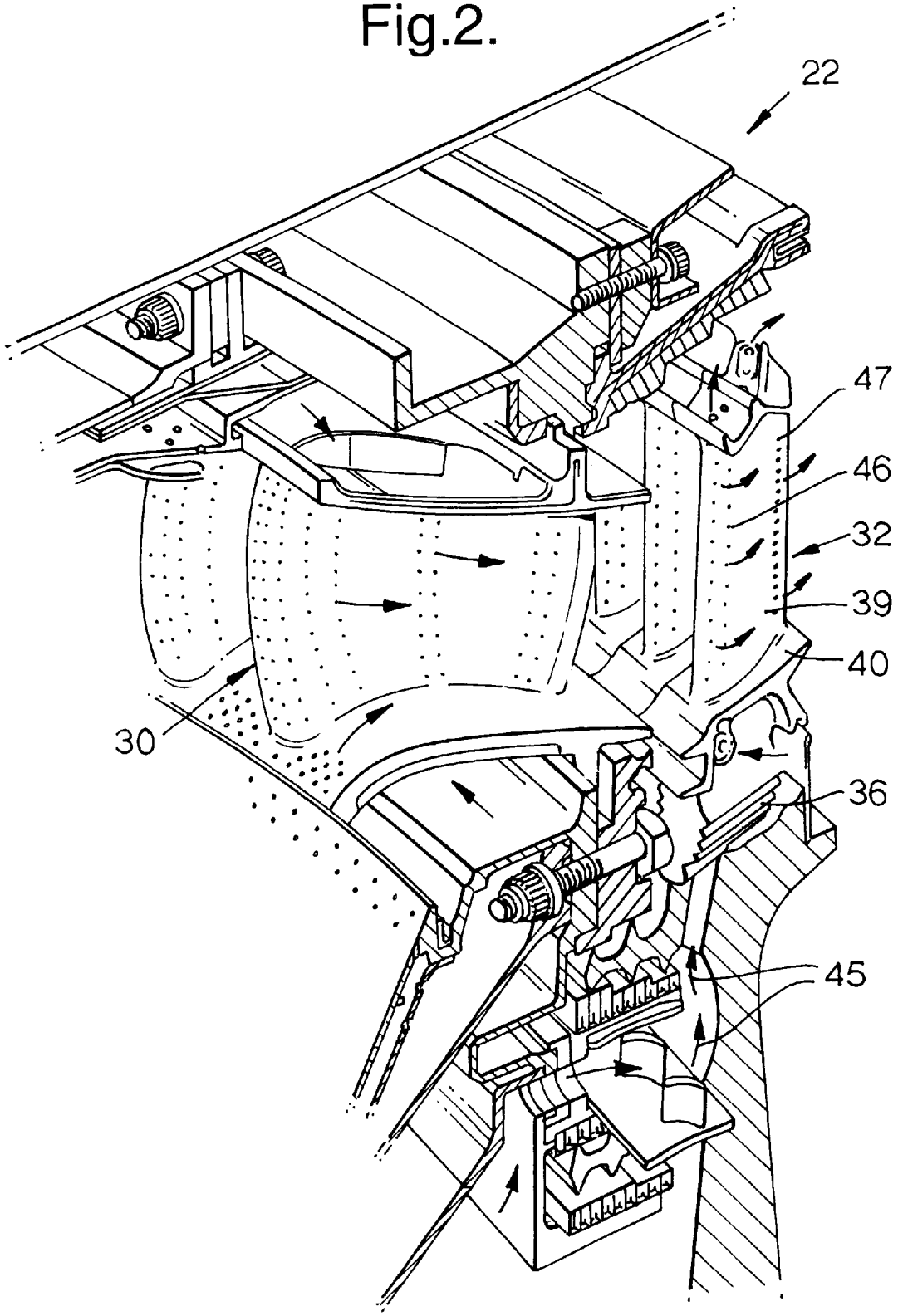
FIG. 2 is a diagrammatic perspective view of a nozzle guide vane and turbine arrangement, illustrating the flow of cooling air.

Referring to FIG. 2, the high pressure turbine stage 22 of the gas turbine engine 10 includes a set of stationary nozzle guide vanes 30 and a set of rotatable turbine blades 32. The set of nozzle guide vanes 30 and the set of turbine blades 32 are each mounted generally in a ring formation, with the vane and the turbine blades extending radially outwardly. Gases expanded by the combustion process in the combustion equipment 20 force their way into discharge nozzles (not illustrated) where they are accelerated and forced onto the nozzle guide vanes 30, which impart a "spin" or "whirl" in the direction of rotation of the turbine blades 32. The gases then impact the turbine blades 32, causing rotation of the turbine.

Figure 3:
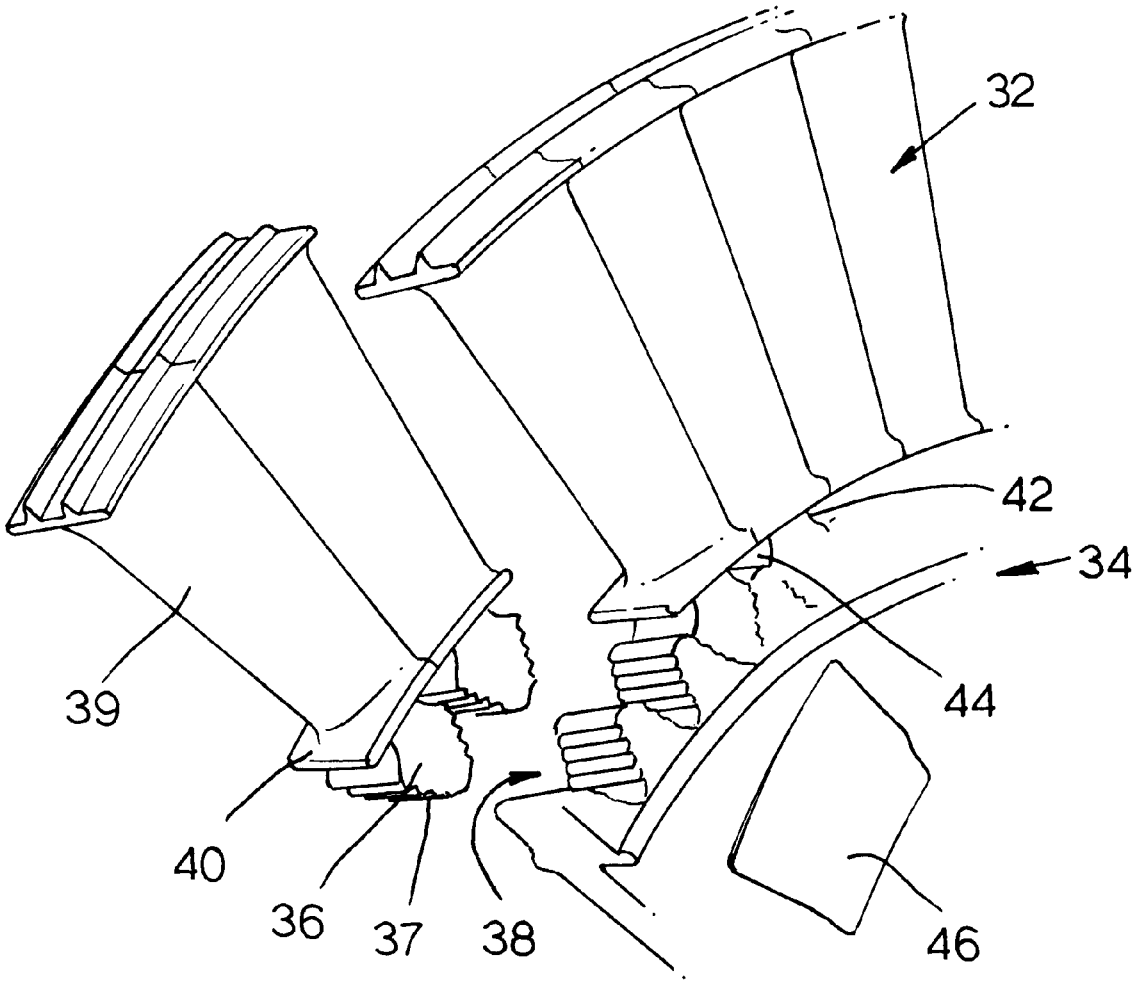
FIG. 3 is a diagrammatic partially exploded perspective view illustrating the mounting of turbine blades on a turbine disc.

Referring to FIG. 3, the turbine blades 32 are mounted on a rotatable support means in the form of a turbine disc 34 by means of "fir tree root" fixings. A root portion 36 of each blade 32 is generally triangular as viewed in the axial direction, but includes serrated edges 37 which cooperate with complementary edges of a recess 38 in the turbine disc 34. The root portion 36 is freely mounted within the recess 38 when the turbine is stationary, but the connection is stiffened by centrifugal loading when the turbine is rotating.

Each turbine blade 32 includes an aerofoil 39 which extends into the working gases flowing axially through the turbine. A blade platform 40 extends circumferentially from each turbine blade 32 at the base of its aerofoil and the blade platforms 40 of adjacent turbine blades abut each other so as to form a smooth annular surface.

Located between the root portion 36 and the blade platform 40 of each turbine blade 32 is a shank 42. Inter-shank spaces 44 occur between the shanks 42 of adjacent turbine blades 32, radially inwardly of the blade platforms 40. Locking plates 46 are positioned at the sides of the fir tree root fixings, enclosing the root portions 36 and shanks 42 of each blade and the inter-shank spaces 44.

The high thermal efficiency of the engine is dependent upon the gases entering the turbine at high temperatures and cooling of the nozzle guide vanes and turbine blades is thus very important. Continuous cooling of these components allows their environmental operating temperature to exceed the melting points of the materials from which they are formed. The arrows in FIG. 2 give an indication of the flow of cooling air in a typical air cooled high pressure nozzle guide vane and turbine blade arrangement. The dark arrows represent high pressure air and the light arrows relatively low pressure air. The high pressure air is used for cooling and has a pressure which is generally 4% to 10% higher than the stagnation pressure (at the front of the blades). The low pressure air results from leakage through seals and generally has a pressure which is up to 5% lower than the stagnation pressure. The temperature of the high pressure air may be as low as 900 K whereas the low pressure air is about 250 K hotter than this. Thus, the pressures and temperatures of the low pressure air are not such that it could be used for cooling purposes.

It may be seen that high pressure air, indicated by the arrows 45, is fed up through the root portion 36 of each blade 32 to an internal region of the blade 32. The air is fed through internal passageways in the blade 32 before being expelled through orifices 47 in the surface of the aerofoil 39, to form a cooling external air film on the surface of the aerofoil 39. However, conventionally the blade platforms 40 of the blades 32 have not been cooled.

Figure 4:
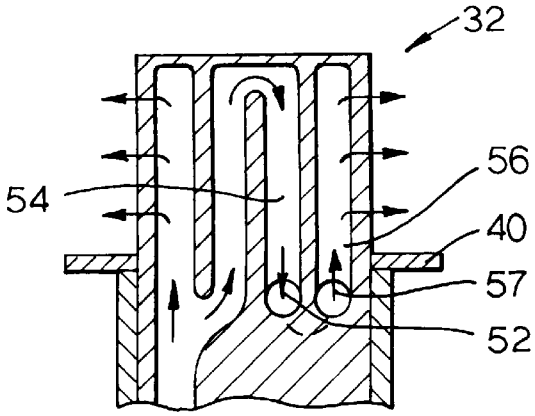
FIG. 4 is a diagrammatic radial section through a turbine blade according to the invention.
Figure 5:
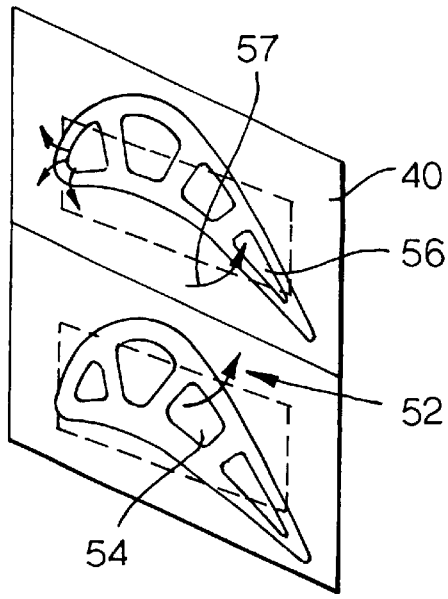
FIG. 5 is a diagrammatic circumferential section through a turbine blade according to the invention.
Figure 6:
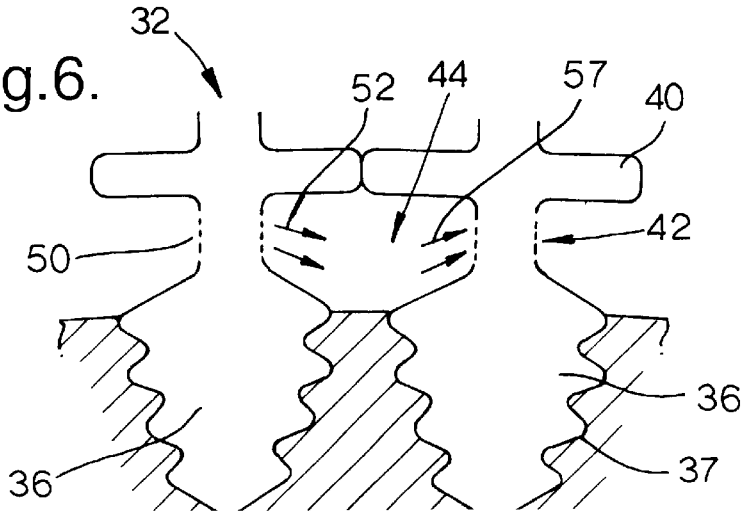
FIG. 6 is a diagrammatic partial radial section through the turbine blade of FIG. 5.

FIGS. 4–6 illustrate a turbine blade 32 according to the invention. When this blade is used in a turbine blade assembly, the internal air flow used to cool the aerofoils 39 may also be utilised to cool the blade platforms 40.

The blade according to the invention is of a generally conventional shape, but is provided with orifices 50 in its shank 42. In use, air may be fed from the internal passageways within the turbine blade 32 out of the orifices 50 and into the inter-shank spaces 44. This air is indicated by the arrows 52 in FIGS. 4–6. The air leaves a first passageway 54 (see FIG. 4) and may subsequently re-enter a lower pressure passageway 56 (see the arrows 57). This passageway 56 may be in the same turbine blade or in an adjacent turbine blade. FIGS. 5 and 6 show the passage of air from a first turbine blade through the inter-shank region 44 and into a lower pressure passageway 56 of an adjacent turbine blade.

The air flow thus cools the undersides of the blade platforms 40, without the need for any additional cooling air other than that lost through leakage. The shanks 42 of the turbine blades are also cooled.

There is thus provided an efficient and straightforward method of cooling the blade platforms 40. The coolant pressure losses may even be less than in the conventional system. This is because air travelling around a bend in a blade according to the conventional multipass system loses about 1.5 dynamic heads of pressure. This pressure loss is not associated with a correspondingly significant cooling effect; it results from the sharpness of the bend. The system according to the invention avoids the air having to negotiate this sharp bend. Discharge into the cavity involves loss of about 1 dynamic head of pressure and re-entry less than 1 dynamic head. Thus the total pressure loss is less, despite the improved cooling. In addition, the cooling holes allow for additional print outs and ease the process of casting the blades.

Various modifications may be made to the above described embodiment without departing from the scope of the invention. For example, the undersides of the blade platforms may be provided with projections or pimples, to increase the cooling effect. Orifices may be provided within the blade platforms, allowing a cooling film to form on top of the blade platforms.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not articular emphasis has been placed thereon.

I claim:

1. A turbine assembly including a plurality of turbine blades mounted on a rotatable support means so as to extend radially therefrom, wherein at least one turbine blade includes a blade platform spaced from the support means and wherein means are provided for allowing the passage of air from an internal region of the blade to a space located between the blade platform and the support means, and wherein means are also provided for allowing the passage of air from the space into the blade.

2. A turbine assembly according to claim 1, wherein the internal region of the blade includes one or more internal passageways for receiving cooling air, and means are provided for allowing the passage of air from a first passageway to the space and for allowing the passage of air from the space to a second passageway.

3. A turbine assembly according to claim 2, wherein the blade includes an aerofoil portion located radially outwardly of the blade platform and the internal passageways extend into the aerofoil portion.

4. A turbine assembly according to claim 1, wherein means are provided for allowing the passage of air from the space into an internal region of an adjacent blade.

5. A turbine assembly according to claim 1, wherein the means for allowing the passage of air includes a plurality of orifices provided in a surface of the turbine blade.

6. A turbine assembly according to claim 5, wherein the blade includes a root portion for mounting the blade on the rotatable support means and a shank portion extending between the root portion and the blade platform, and wherein the orifices are provided in the shank portion.

7. A turbine assembly according to claim 6, wherein the assembly includes means for providing cooling air to the turbine blade via a passageway extending through its root portion.

8. A method of cooling a turbine assembly according to claim 1, the method including the steps of passing air from an internal region of said one turbine blade to said space; and passing air from said space into the internal region of said one turbine blade or of an adjacent turbine blade.

9. A turbine blade adapted for use in a turbine assembly according to claim 1.

* * * * *